US006486778B2

(12) United States Patent
Mahler et al.

(10) Patent No.: US 6,486,778 B2
(45) Date of Patent: Nov. 26, 2002

(54) PRESENCE DETECTOR AND ITS APPLICATION

(75) Inventors: Hansjürg Mahler, Hombrechtikon (CH); Martin Rechsteiner, Männedorf (CH); Rolf Abrach, Wald (CH)

(73) Assignee: Siemens Building Technologies, AG, Mannedorf (CH)

( * ) Notice: Subject to any disclaimer, the term of this patent is extended or adjusted under 35 U.S.C. 154(b) by 0 days.

(21) Appl. No.: 09/735,732

(22) Filed: Dec. 13, 2000

(65) Prior Publication Data

US 2001/0015409 A1 Aug. 23, 2001

(30) Foreign Application Priority Data

Dec. 17, 1999 (EP) ..... 99 125 169

(51) Int. Cl.[7] ..... G08B 13/18

(52) U.S. Cl. ..... 340/567; 250/214 AL; 250/342

(58) Field of Search ..... 340/567; 250/214 AL, 250/342, DIG. 1

(56) References Cited

U.S. PATENT DOCUMENTS 4,511,886 A 4/1985 Rodriguez ..... 340/534
4,857,912 A * 8/1989 Everett, Jr. et al. ..... 340/541 X
5,382,943 A * 1/1995 Tanaka ..... 340/539
5,598,042 A * 1/1997 Mix et al. ..... 340/541 X
6,137,407 A * 10/2000 Akagawa et al. ..... 340/552
6,246,321 B1 * 6/2001 Rechsteiner et al. .... 340/567 X

FOREIGN PATENT DOCUMENTS

| | | |
|---|---|---|
| EP | 0591585 | 4/1992 |
| FR | 2700046 | 7/1994 |
| WO | 9641502 | 12/1996 |

* cited by examiner

*Primary Examiner*—Thomas Mullen
(74) *Attorney, Agent, or Firm*—BakerBotts LLP

(57) ABSTRACT

The presence detector has a passive infrared sensor for detecting the presence of persons in a room, an image sensor operating in the visible spectral range and an electronic evaluator for the evaluation of signals from these sensors. The signal from the passive infrared sensor is used to actuate the image sensor and, if necessary, to switch on the room lighting. Once activated, the image sensor is used to detect both movement and occupancy of a space being monitored. Application of the presence detector for the "on-demand" activation and/or control of conditioning facilities of a room, wherein the signals of both sensors are used for the control of the conditioning facility.

16 Claims, 2 Drawing Sheets

PRESENCE DETECTOR AND ITS APPLICATION

BACKGROUND OF THE INVENTION

1. Field of the Invention

The present invention relates generally to a presence detector having a passive infrared sensor for detecting the presence of stationary persons in a room.

2. Description of the Related Art

In modem presence detectors, the passive infrared sensor is equipped with a pyro-sensor for detecting thermal radiation and a structure for focusing the thermal radiation from the room being monitored, which impinges upon the pyro-sensor. The signal of the pyro-sensor detects movements of heat sources which differ from the ambient temperature in the room being monitored (see EP-A-0 303 913, for example). Today, such passive infrared sensors are obtainable in many versions and at favorable prices. However, conventional infrared sensors are either unable, or poorly able, to detect stationary persons working, for example, at a PC. Therefore, passive infrared sensors have only limited use in presence detectors in an office environment. Furthermore, it is not possible to determine the level of occupancy of a room with the passive infrared sensors currently available on the market.

If, instead of a conventional passive infrared sensor, a passive infrared sensor array using so-called thermopile technology is employed (see European patent application 98 115 476.8), then the presence detector can indeed detect stationary objects which exhibit a temperature difference vis-a-vis the environment, and also respond to warm objects such as heaters, computers or locations exposed to sunlight. However, for sufficiently high resolution, these sensor arrays are currently still very expensive. Accordingly, an improved presence detector which can detect stationary persons that is manufactured at competitive price is required.

SUMMARY OF INVENTION

An object of the present presence detector is to reliably detect stationary persons and to distinguish them from warm objects in the room.

Another object is to provide a cost effective presence detector that can determine the level of occupancy of a room.

These and other objects are achieved with a presence detector of the type referred to at the outset, in that an image sensor operating in the visible spectral range, and an electronic evaluator for the evaluation of the image information, are provided in addition to the passive infrared sensor. The signals of both sensors are then evaluated and the passive infrared sensor signal is used to activate the image sensor. If necessary, it is also used to switch on the room lighting.

The monitoring of the room for the presence of persons is primarily carried out by the image sensor. The passive infrared sensor is mainly used to activate the image sensor and to switch on the lighting of the relevant room if this is necessary. This arrangement has an added advantage that the image sensor can always operate under adequate light conditions. Since the image sensor operates in the visible spectral range, it cannot "see" in the dark, and with insufficient brightness it has to rely on suitable lighting.

In one embodiment, the presence detector includes a rapid reaction passive infrared sensor to switch on the lighting of the relevant room when entered by a person. Due to the use of the rapid reaction passive infrared sensor, which switches on the room lighting as soon as a person enters a room in which there are inadequate lighting conditions, the image sensor is always present in an adequately illuminated room and no additional lighting adjustments are needed for the proper functioning of the image sensor.

In another embodiment, the image sensor is provided to detect the presence of persons in the relevant room.

The image sensor can take the form of a complimentary metal-oxide semiconductor (CMOS) image sensor or is an active pixel sensor.

The image sensor scans the room to be monitored by imaging, digitizing the image and storing it as a reference image in a memory. The use of an active pixel sensor, which is characterized by a very low power consumption, makes it possible to access individual pixels. If the active pixel sensor consists of a sufficiently large number of pixels, raster scanning is obtained in which even small movements, such as hand movements, for example, can be detected. In the active state of the presence detector, the image sensor generates an image of the monitored room at intervals of fractions of a second, stores these images for a specific time and compares them with the reference image and/or with each other.

In a further embodiment of the presence detector, the image sensor is designed to measure the ambient brightness. In this regard, the image sensor can have an arrangement for measuring the ambient brightness, such as a photo-diode operationally coupled with the image sensor.

In other embodiments, the passive infrared sensor switches on the lighting when this is actually required, and the lighting can be switched off by the image sensor when, because of adequate brightness, it is no longer required.

In a further preferred embodiment of the presence detector, the image sensor's visual range is subdivided into several partial areas, and a separate evaluation of the sensor signal for each partial area takes place during the evaluation of the image sensor signal. This embodiment has the advantage that the occupancy of the room, that is to say, the number of persons in it, can be at least estimated and used, for example, for the control of heating/ventilation/air-conditioning as required.

In a yet another embodiment of the presence detector, the image sensor has an optical system for displaying several partial areas on the same display area. This results in multiple use of the image sensor and an increase in resolution, allowing an image sensor of a lower resolution to be used, which leads to a corresponding cost reduction for the image sensor.

The invention further concerns a use of the presence detector for the "on-demand" activation and/or control of conditioning facilities of a room. Conditioning facilities are understood to be facilities for influencing the ambient conditions prevailing in the respective room, such as room brightness or climate. At least for reasons of energy savings, there is a requirement to regulate ambient conditions, in particular to switch off or reduce the lighting, heating, ventilation, and air-conditioning in empty rooms and to switch them on or to adjust them to normal operation as soon as somebody enters the room. Moreover, "on-demand" control means the control of heating/ventilation/air-conditioning according to the number of persons located in a room.

Accordingly, the signal of the passive infrared sensor can be used to activate the image sensor and, if necessary, to switch on the room lighting. Additionally, the ambient brightness may be measured and used to determine whether to switch the room lights off. The signals of both sensors are used to control the heating, ventilation, and/or air-conditioning of the room. The image sensor signal is additionally used to switch-off the lighting.

DESCRIPTION OF THE DRAWINGS

The invention is explained in further detail below with the aid of an exemplary embodiment and the drawings, of which.

Figure 1:
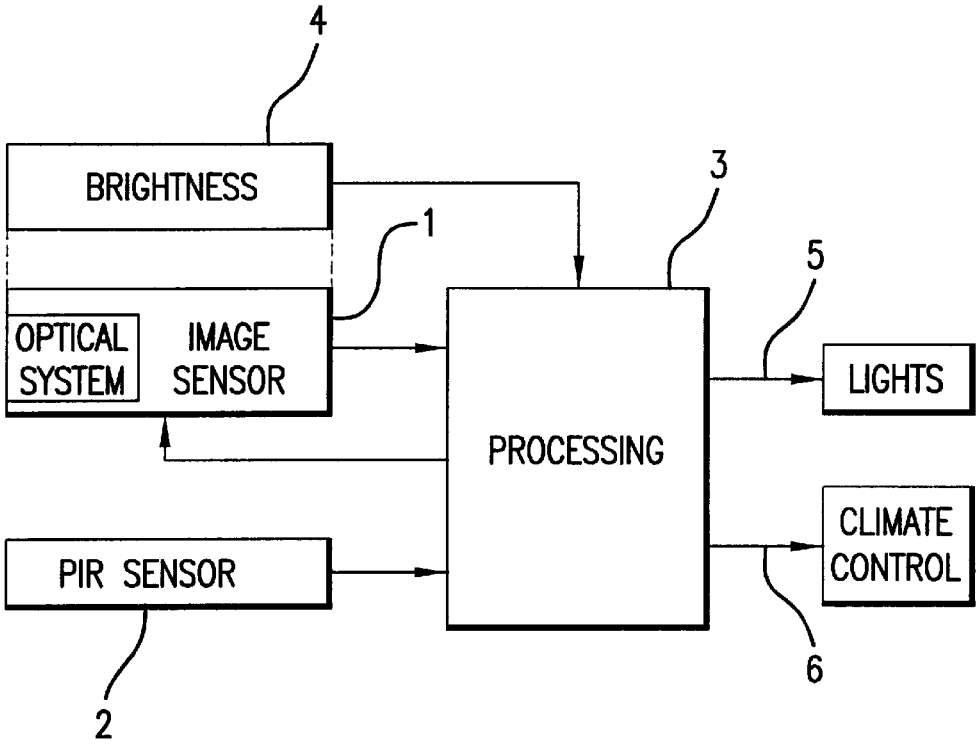
FIG. 1 is a block diagram of a presence detector according to the invention.

Throughout the figures, the same reference numerals and characters, unless otherwise stated, are used to denote like features, elements, components or portions of the illustrated embodiments. Moreover, while the subject invention will now be described in detail with reference to the figures, it is done so in connection with the illustrative embodiments. It is intended that changes and modifications can be made to the described embodiments without departing from the true scope and spirit of the subject invention as defined by the appended claims.

DESCRIPTION OF PREFERRED EMBODIMENTS

The presence detector illustrated in FIG. 1 substantially consists of an image sensor 1 operating in the visible spectral range, a passive infrared sensor 2 and, connected to these, an electronic evaluator 3 for controlling the sensors and for processing and evaluating the sensor signals. The image sensor 1 is equipped with a brightness sensor 4 such as a photo-diode for measuring the ambient brightness, which is likewise connected to the electronic evaluator 3. Alternatively, the image sensor 1 can be designed to measure the ambient brightness, whereby it measures a value for the brightness of the pixels in its visual range by means of the known integration time. This value can be the average value or a histogram or the maximum value of the brightness of the pixels, for example.

The presence detector is intended to determine the presence of persons in a room and, based on the result of this monitoring, to control the lighting of the room, as well as its heating/ventilation/air-conditioning and, optionally, other conditioning facilities. Here the term "control" is understood to mean regulation as well as switching on and off. According to this dual function of the presence detector, the electronic evaluator includes an output 5 for controlling the lighting and an output 6 for controlling the heating/ventilation/air-conditioning of the relevant room.

The aim of such a control is to configure the room conditioning and lighting so that maximum comfort is achieved with minimum energy expenditure. This means, among other things, switching on the room lighting and leaving it switched on only when there are persons in the room, and also adjusting the heating/ventilation/air-conditioning of the room according to the presence or absence of persons in the room. In the latter case knowledge of the room occupancy being desirable.

The image sensor 1 is sensitive in the visible light range and can take the form of a number of known devices, such as a charge-coupled device or CCD, charge-injection device or CID, or complementary metal oxide semiconductor or CMOS. Preferably, a special CMOS image sensor, often referred to as an Active Pixel Sensor (APS) is used, which is characterized by a very low power consumption and the ability to access individual pixels. Moreover, additional application-specific analog or digital functions, i.e., simple image processing algorithms such as filter or exposure control, can be easily integrated in such an APS. For further generally well known information regarding an APS, reference is made to the article "A 128×128 CMOS Active Pixel Image Sensor for Highly Integrated Imaging Systems" by Sunetra K. Mendis, Sabrina E. Kennedy and Eric R. Fossum, IEDM 93-538 and "128×128 CMOS Photodiode-type Active Pixel Sensor with On-Chip timing, Control and Signal Chain Electronics" by R. H. Nixon, S. E. Kemeny, C. O. Staller and E. R. Fossum in SPIE Vol. 24151117.

The image sensor 1 is directed towards the room to be monitored. The image sensor 1 scans the room by imaging, digitizes the image and stores it as a reference image in a memory. If the image sensor 1 consists of 256×256 pixels, for example, and uses a wide-angle optical system at a distance of 15 meters in front of the image sensor 1, one pixel would then correspond to an area of about 12×12 cm. Such a raster scan is designed to detect even small movements of parts of the body, for example a hand or head.

In the active state of the device, the image sensor 1 generates images of the monitored room at intervals of fractions of a second. The image sensor, then, stores these images for a certain time and compares then with the reference image and/or with each other. During this comparison, data relevant to movements in the room, for example the number of pixels changed in relation to the reference image or a movement of the objects, etc., are determined. If, for example, the number of changed pixels reaches a specific value, this is interpreted as movement in the monitored room.

Since the image sensor 1 is sensitive in the visible light region, it requires sufficient room lighting to perform the imaging function. This adequate lighting is ensured by the passive infrared sensor 2, which, if necessary, switches on the lighting after somebody enters the room. Since entry into the room is always associated with large movements, the passive infrared sensor 2 can reliably and rapidly react to such events. This way, the image sensor 1 is always operating in an adequately illuminated room. Advantageously, the image sensor 1 is switched off during the times when there is nobody in the room, and is activated by the passive infrared sensor 2 when entry is detected. The brightness sensor 4 makes a periodic measurement of the room brightness so that the lighting is only switched on when this is required. For reasons of brightness, the lighting can also be switched off by means of the signal of the brightness sensor 4 as soon as it is no longer required.

A second criterion for switching off the lighting is the absence of persons in the relevant room. This switching-off is effected by means of the signal of the image sensor 1, which as soon as movement is no longer recorded starts a counter provided in the processing stage 3, which is reset at the appearance of a new motion signal, whether it be from the image sensor 1 or from the passive infrared sensor 2. If no motion signal appears, then the counter continues to run and the lighting is switched off at a specific counter reading. To prevent unnecessary lighting, provision can also be made for lighting already switched on to remain switched on only when a sufficiently large signal of the passive infrared sensor 2 occurs with a sufficiently large time constant. The time constant can be set at 45 to 60 minutes because it can be assumed that even a person working at a PC makes a movement at least every 45 minutes that is detectable by the passive infrared sensor 2.

There is a further possibility of increasing the robustness or precision of the presence detector by filtering or masking out repetitious movements in defined areas of the room, caused by oscillating objects such as curtains, fans or leaves of plants, for example.

While integral motion monitoring over the entire room is adequate for the switching-on and switching-off of the lighting (output 5), the room occupancy required for "on-demand" control of ventilation/heating/air-conditioning (output 6) can only be obtained by further evaluation of the image signal. For example, this further evaluation is effected by subdividing the visual range of the image sensor 1 into several partial areas and evaluating the sensor signal separately for each partial area. It can then be ascertained for each partial area whether a person is occupying this partial area. This way, the occupancy of a room can at least be estimated and the ventilation/heating/air-conditioning suitably controlled.

The APS forming the image sensor 1 can, for example, be an active pixel sensor with additional signal evaluation in the pixels. This signal evaluation can preferably involve amplification of time changes and inhibiting interaction between adjacent pixels so that moving contours are emphasized (so-called neuromorphic sensors or artificial retinas). In this way motion detection is implemented directly on the chip and internal logic can, for example, count the number of activated pixels or measure the size of pixel accumulations (clusters), where the number of persons in the room is likewise estimated and a signal can be generated when suitable thresholds are exceeded.

Figure 2:
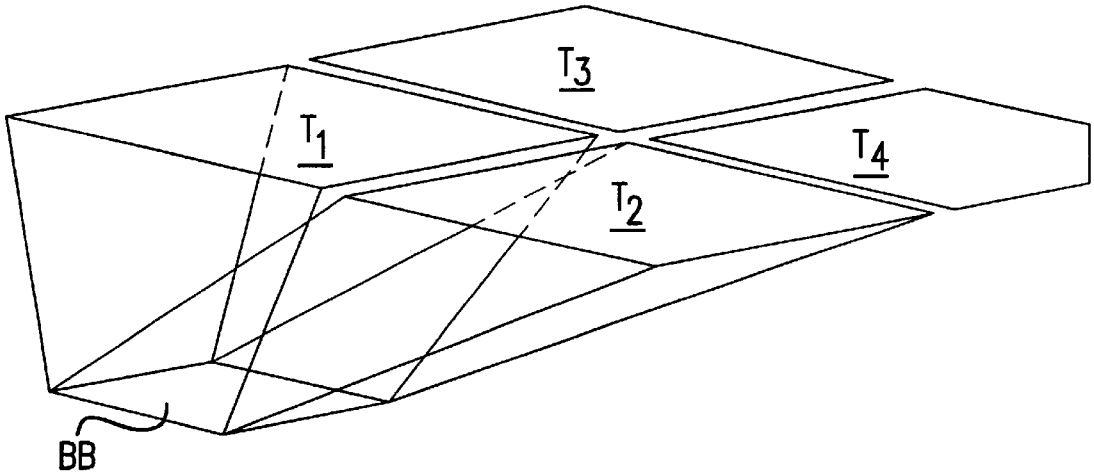
FIG. 2 is a simplified perspective diagram illustrating a detailed variant of an optical system for the presence detector shown in FIG. 1.

It has already been mentioned that the visual range of the image sensor 1 can be subdivided into several partial areas. Instead of evaluating these partial areas separately, the optical system (not shown) of the image sensor 1 can be designed so that, as shown in FIG. 2, several partial areas $T_1$ to $T_4$ can be displayed on the same image area BB. Due to this multiple use of the image sensor 1, (virtual) resolution is gained so that for constant local resolution an image sensor of a lower resolution can be used. The fact that the unambiguous local resolution is lost is immaterial as long as the sensor is intended only to detect movements.

In order to prevent prolonged connection of the lighting due to a faulty signal from the passive infrared sensor 2, shortly after the lighting is switched on, the signal from the image sensor 2 can be analyzed for unambiguous moving objects, or object tracking (following the path of the person concerned) also carried out. This is therefore useful because experience shows that shortly after entering a room a person still makes relatively strong movements and can thus be very easily detected by the image sensor 1.

Figure 3:
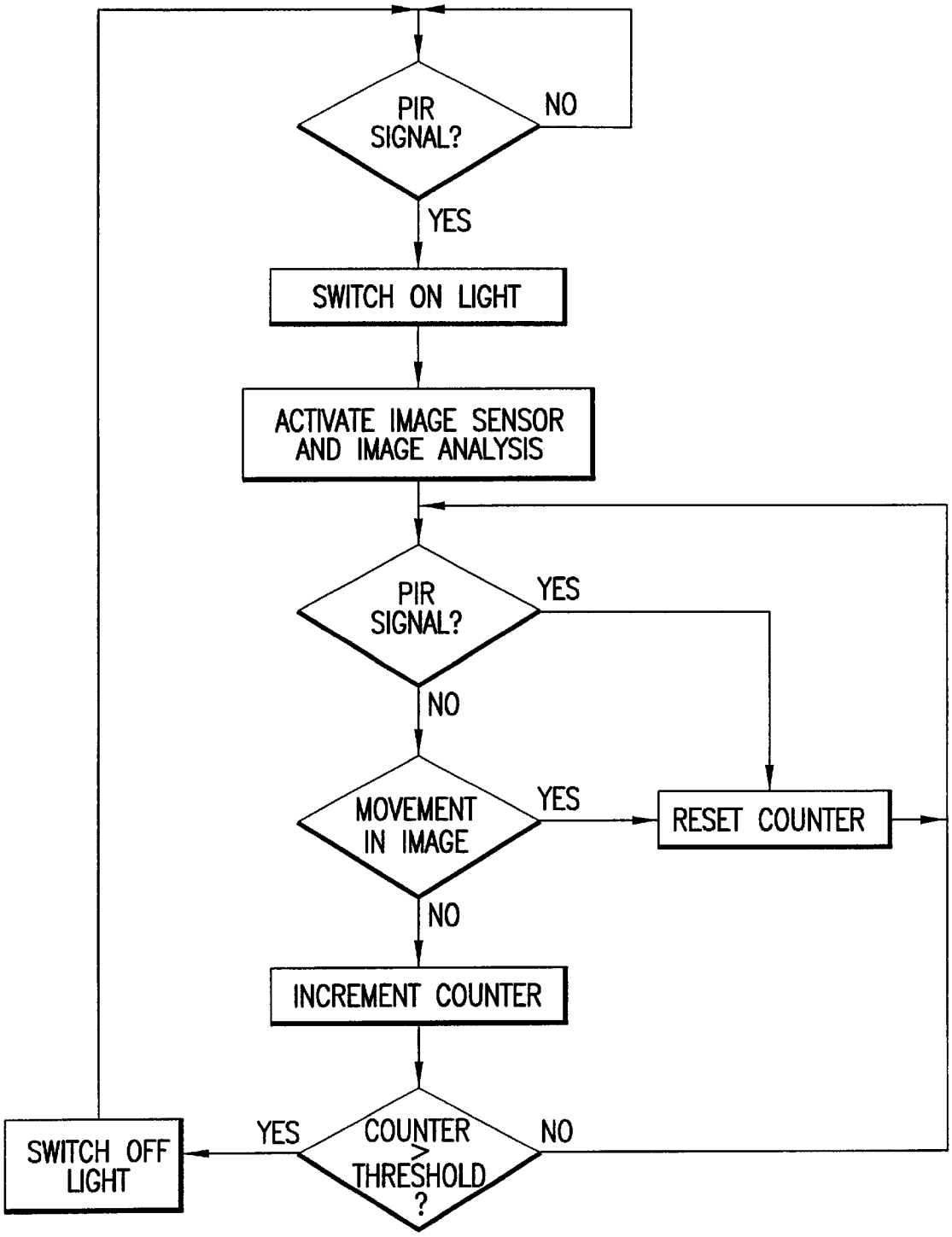
FIG. 3 is a flowchart of a simple signal evaluation process in accordance with the present system.

It can be seen from the flowchart illustrated in FIG. 3 that on the appearance of a signal from the passive infrared sensor 2, the image sensor is activated with the image analysis (steps 302, 306). If the lighting conditions demand it, the room lighting is also switched on by the signal from the passive infrared sensor 2 (step 304). During the image analysis, images recorded by the image sensor 1 are examined for movements (step 310). If no movement is found, the reading of a counter is incremented (step 314); the counter reading is reset to zero at each detected movement (step 312). In the active state of the image sensor 1, the passive infrared sensor 2 is, of course, also active and likewise generates a reset command to the counter on detection of a movement (step 308, 312). The counter reading is then compared to a threshold and the lighting is switched off if this threshold is exceeded (steps 316, 318).

For example, if the image sensor records one image every second and examines it, and if the time constant of the presence detector is set so that the room lighting is switched off 20 minutes after the last movement, then the counter reading must exceed the value 1200 so that the light is switched off.

As already mentioned, the simple signal evaluation illustrated in FIG. 3 can be refined in virtually any way. For example, provision can be made for the lighting to be switched off if the passive infrared sensor 2 does not deliver a signal at specific intervals, and/or as a condition for leaving on the lighting which has just been switched on it can be stipulated that the image sensor 1 detects a movement shortly after the lighting is switched on by the passive infrared sensor 2.

The signal evaluation shown in FIG. 3 is correspondingly expanded for the regulation of heating/ventilation/control (output 6 of the electronic evaluator 3).

Although the present invention has been described in connection with specific exemplary embodiments, it should be understood that various changes, substitutions and alterations can be made to the disclosed embodiments without departing from the spirit and scope of the invention as set forth in the appended claims.

We claim:

1. A presence detector system comprising a passive infrared sensor, an image sensor operating in the visible spectral range to detect a presence, and an electronic evaluator operationally coupled with the passive infrared sensor and the image sensor for a combined evaluation of the sensors' signals, and wherein the image sensor is activated in response to a signal from the passive infrared sensor and further wherein the electronic evaluator has at least one output for operating a conditioning facility for affecting ambient conditions prevailing in a space.

2. A presence detector of claim 1, wherein said conditioning facility includes lights in a room and said lights are operated in response to a signal from said passive infrared sensor indicating that a person has entered.

3. A presence detector of claim 1, wherein said image sensor's visual range is subdivided into a plurality of partial areas, each of said partial areas being imaged on the same area of the image sensor.

4. A presence detector of claim 3, wherein said electronic evaluator further evaluates signals from said image sensor to determine any movements in said visual range of said image sensor.

5. A presence detector of claim 3, further comprising an optical system for subdividing the visual range and presenting said plurality of partial areas onto said image sensor.

6. A presence detector of claim 1, wherein said electronic evaluator further evaluates signals from said image sensor to determine any movements in a visual range of said image sensor.

7. A presence detector system comprising a passive infrared sensor, an image sensor operating in the visible spectral range selected from the group consisting of a complementary metal oxide semiconductor image sensor and an active pixel sensor, and an electronic evaluator operationally coupled with the passive infrared sensor and the image sensor, and wherein the image sensor is activated in response to a signal from the passive infrared sensor, and the electronic evaluator has at least one output for operating a conditioning facility.

8. A presence detector system comprising a passive infrared sensor, an image sensor operating in the visible spectral range, and an electronic evaluator operationally coupled with the passive infrared sensor and the image sensor, wherein the image sensor is activated in response to a signal from the passive infrared sensor, and the electronic evaluator has at least one output for operating a conditioning facility, further wherein the image sensor provides a signal to the electronic evaluator having a measure of ambient brightness.

9. A presence detector of claim 8, wherein a signal from said image sensor is used to operate lighting in a room when the ambient brightness is sufficient to operate the image sensor.

10. A presence detector system comprising a passive infrared sensor, an image sensor operating in the visible spectral range, and an electronic evaluator operationally coupled with the passive infrared sensor and the image sensor, wherein the image sensor is activated in response to a signal from the passive infrared sensor, and the electronic evaluator has at least one output for operating a conditioning facility, further wherein the image sensor comprises a brightness sensor operationally coupled with the electronic evaluator.

11. A presence detector of claim 10, wherein said brightness sensor further comprises a photo-diode.

12. A presence detector of claim 10, wherein said electronic evaluator determines an ambient brightness based on a signal from said brightness sensor, and wherein said electronic evaluator further controls lighting in the operational range of said image sensor based on the determined ambient brightness.

13. A presence detector claim 12, wherein a signal from said image sensor is further used to operate the lighting.

14. A presence detector system comprising a passive infrared sensor, an image sensor operating in the visible spectral range, and an electronic evaluator operationally coupled with the passive infrared sensor and the image sensor, wherein the image sensor is activated in response to a signal from the passive infrared sensor, and the electronic evaluator has at least one output for operating a conditioning facility, wherein the conditioning facility comprises a climate control system and the electronic evaluator provides control signals on the output to control said climate control system.

15. A presence detector of claim 14, wherein said electronic evaluator determines the occupancy of the room in response to the image sensor and wherein said control signals are related to said occupancy.

16. A presence detector of claim 14, wherein said control signals are related to both the PIR and image sensor.

* * * * *